US007588023B2

(12) United States Patent
Kung et al.

(10) Patent No.: US 7,588,023 B2
(45) Date of Patent: Sep. 15, 2009

(54) ACTION STRUCTURE

(75) Inventors: Shih-Che Kung, Sanchong (TW); Wei-Hung Chung, Sanchong (TW)

(73) Assignee: Vega Force International Corp., Taipei County (TW)

( * ) Notice: Subject to any disclaimer, the term of this patent is extended or adjusted under 35 U.S.C. 154(b) by 297 days.

(21) Appl. No.: 11/647,180

(22) Filed: Dec. 29, 2006

(65) Prior Publication Data

US 2008/0156309 A1 Jul. 3, 2008

(51) Int. Cl.
*F41B 7/00* (2006.01)

(52) U.S. Cl. ..... 124/27; 124/16; 124/31; 434/18

(58) Field of Classification Search ..... 124/16, 124/27, 28, 31, 73, 74; 434/18
See application file for complete search history.

(56) References Cited

U.S. PATENT DOCUMENTS 3,209,741 A * 10/1965 Hiroshi ..... 124/49
3,394,694 A * 7/1968 Leclerc ..... 124/27
3,408,997 A * 11/1968 De Ruymbecke et al. ..... 124/27
3,859,977 A * 1/1975 Lange ..... 124/66
5,634,456 A * 6/1997 Perrone ..... 124/76
6,382,200 B1 * 5/2002 Levkov ..... 124/73
6,874,492 B1 * 4/2005 Schavone ..... 124/31
7,111,621 B2 * 9/2006 Lin ..... 124/74

* cited by examiner

*Primary Examiner*—John Ricci
(74) *Attorney, Agent, or Firm*—Troxell Law Office PLLC

(57) ABSTRACT

An action structure is composed of a handle part, an action part, a tenon part, and a trajectory adjusting device. An extended handle extension seat drives a corresponding action piece through an operation of the handle, and an action piece inner tenon is located at a lower rim of the action. The action piece is fixed at a rear side through this latching effect, and at a same time, the trajectory adjusting device which is enclosed by the action piece is exposed for an adjustment of the trajectory. In addition, an action release tenon is assembled with the action piece inner tenon through an extended tenon extension rod, such that the action piece can be restored to an original position by pressing the action release tenon, thereby enabling a recoil movement of the action to achieve an effect of simulating a real gun.

3 Claims, 6 Drawing Sheets

ACTION STRUCTURE

BACKGROUND OF THE INVENTION a) Field of the Invention

The present invention relates to an action structure, and more particularly to an action structure, wherein a handle is extended with a handle extension seat to drive an action piece, and a lower rim of the action piece is provided with a corresponding action piece inner tenon, such that the action piece can be fixed at a rear side through this latching effect, and a trajectory adjusting device which is enclosed by the action piece can be exposed for an adjustment of the trajectory. In addition, an action release tenon is assembled with the action piece inner tenon through an extended tenon extension rod.

b) Description of the Prior Art

Although a conventional toy gun is provided with an action piece and an action release tenon, the action piece and the action release tenon are only provided with an effect of beauty, and are not equipped with functions of fixing the action piece at a rear side and of releasing the action piece, which will result in that a trajectory adjusting device cannot be adjusted easily.

Therefore, how to eliminate the aforementioned problems is a technical issue to be solved by the present inventor.

SUMMARY OF THE INVENTION

The primary object of present invention is to provide an action structure, wherein a handle is extended with a handle extension seat to drive an action piece, and a lower rim of the action piece is provided with a corresponding action piece inner tenon, such that the action piece can be fixed at a rear side by this latching effect, and at a same time, a trajectory adjusting device which is enclosed by the action piece can be exposed for an adjustment of the trajectory. In addition, an action release tenon is assembled with the action piece inner tenon through an extended tenon extension rod, such that the action piece can be restored to an original position by pressing the action release tenon, thereby enabling a recoil movement of the action piece to achieve an effect of simulating a real gun.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
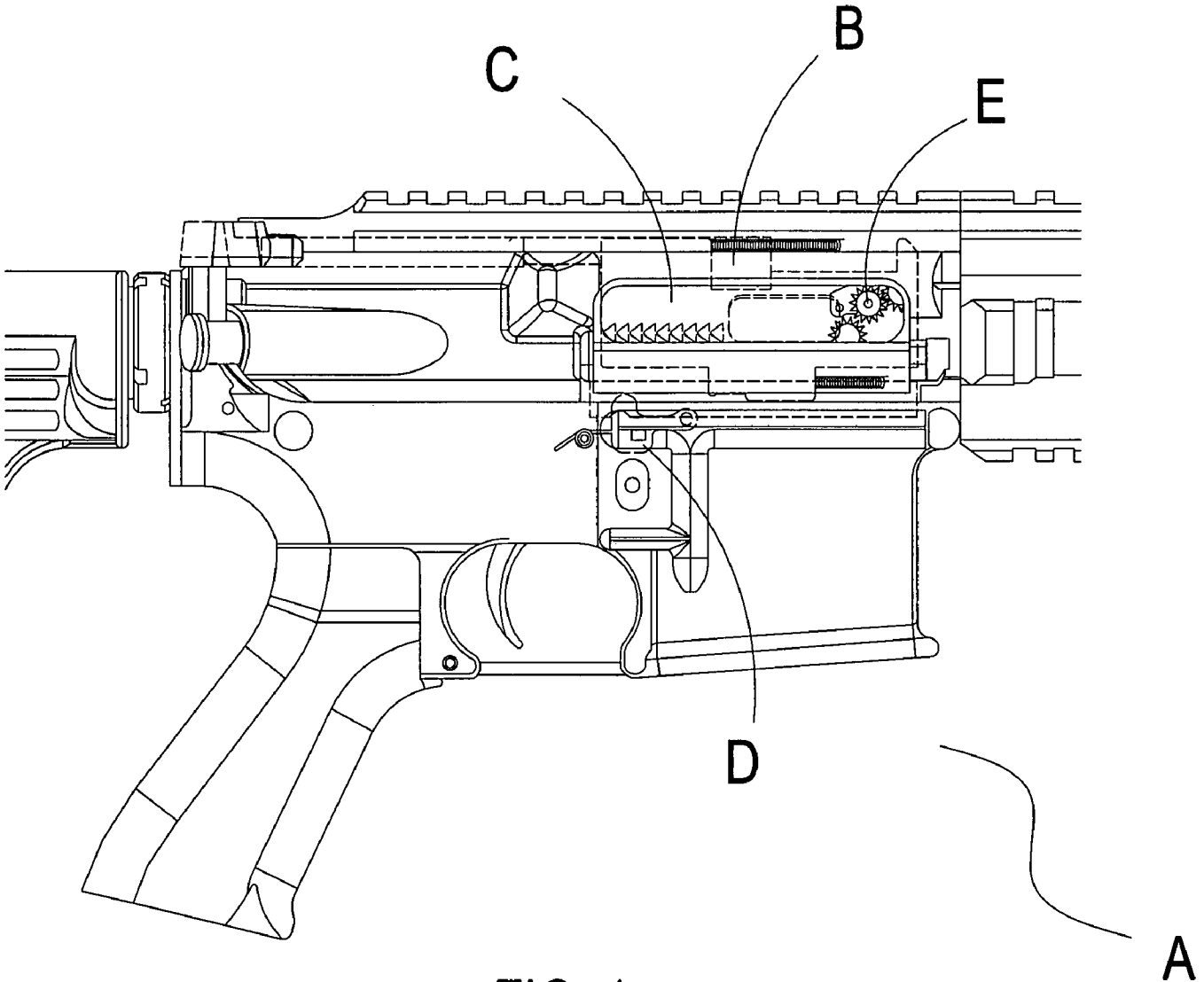
FIG. 1 shows a perspective view of the present invention.
Figure 2:
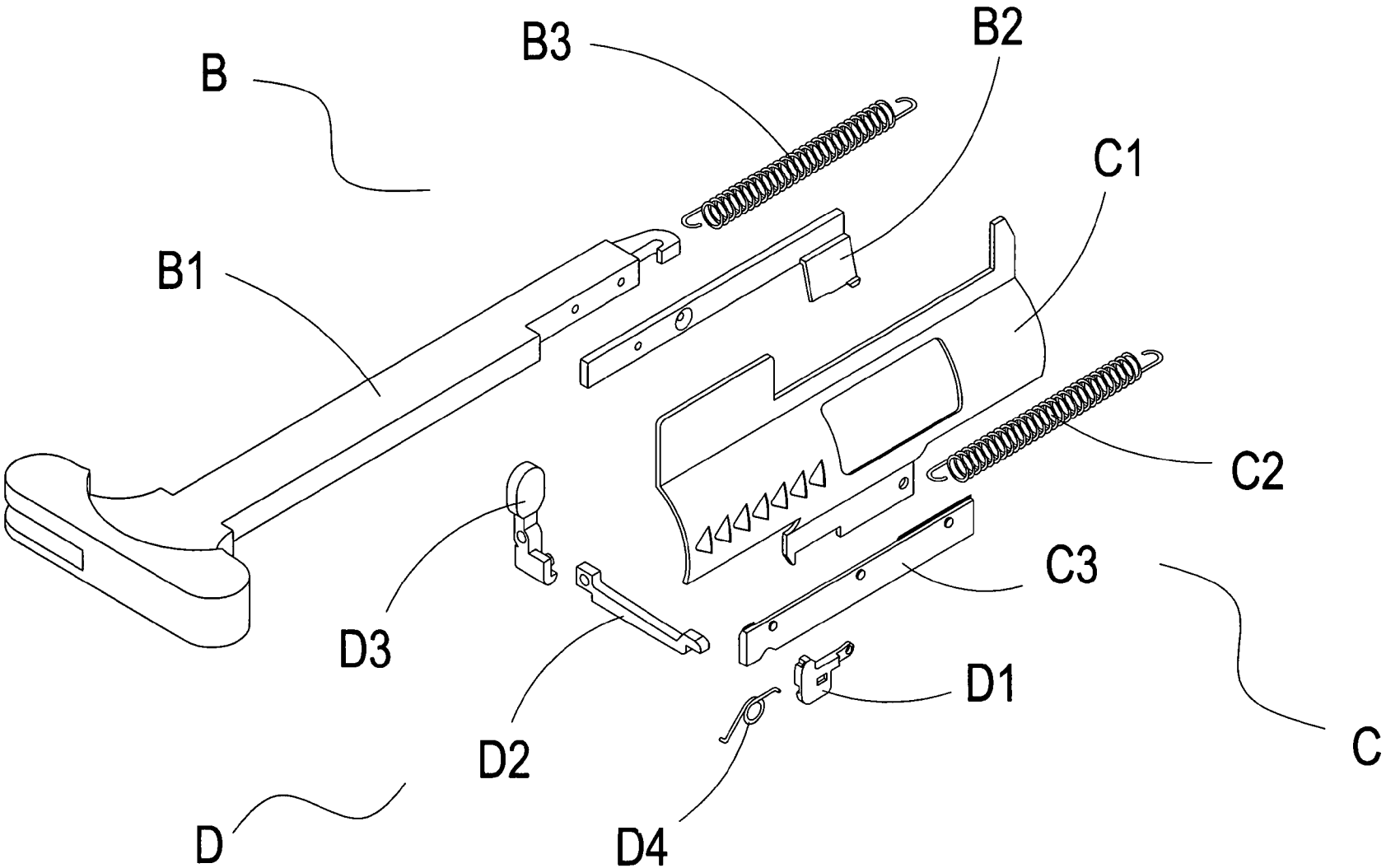
FIG. 2 shows an exploded view of the present invention.
Figure 3:
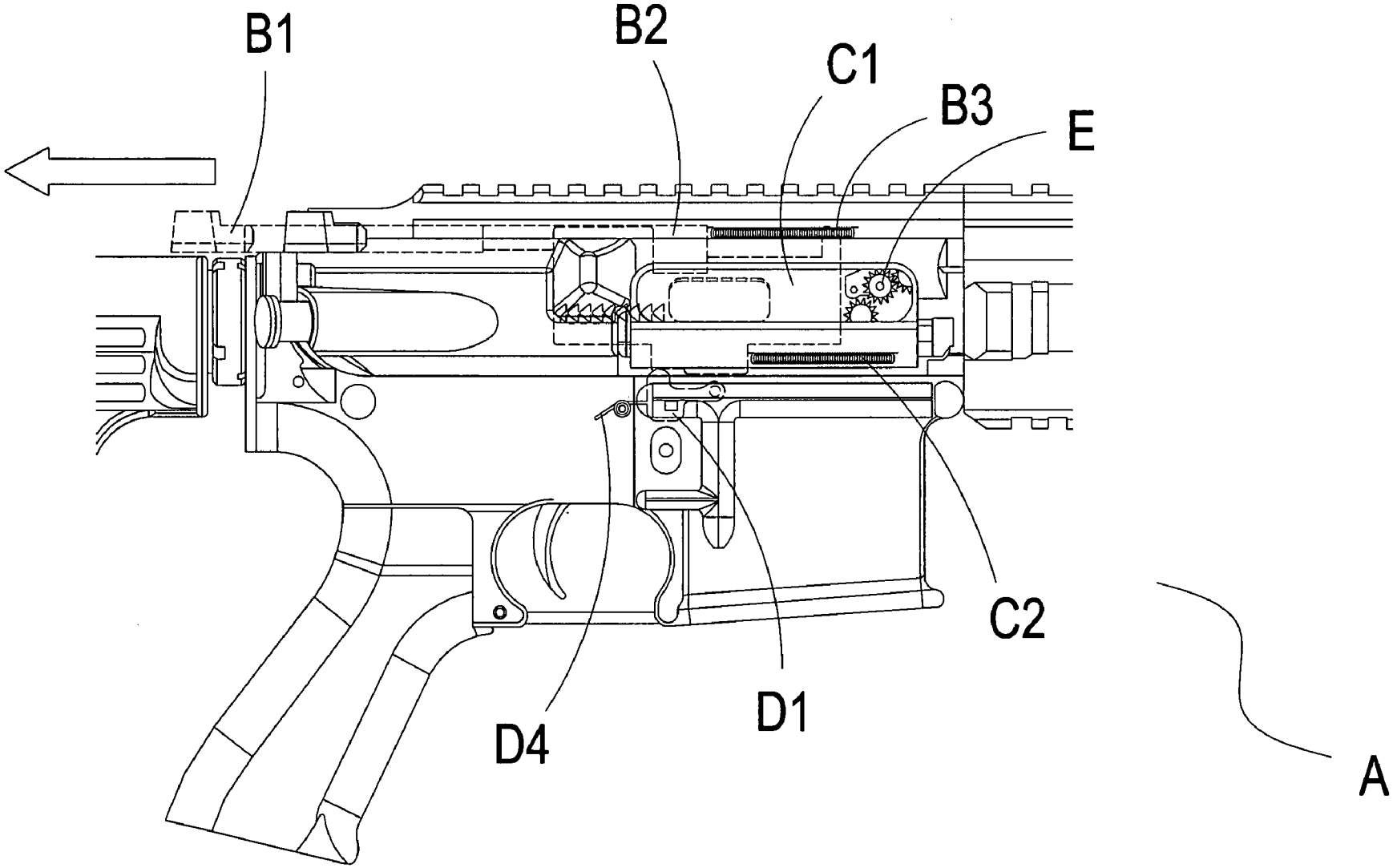
FIG. 3 shows a first schematic view of an embodiment of the present invention.
Figure 4:
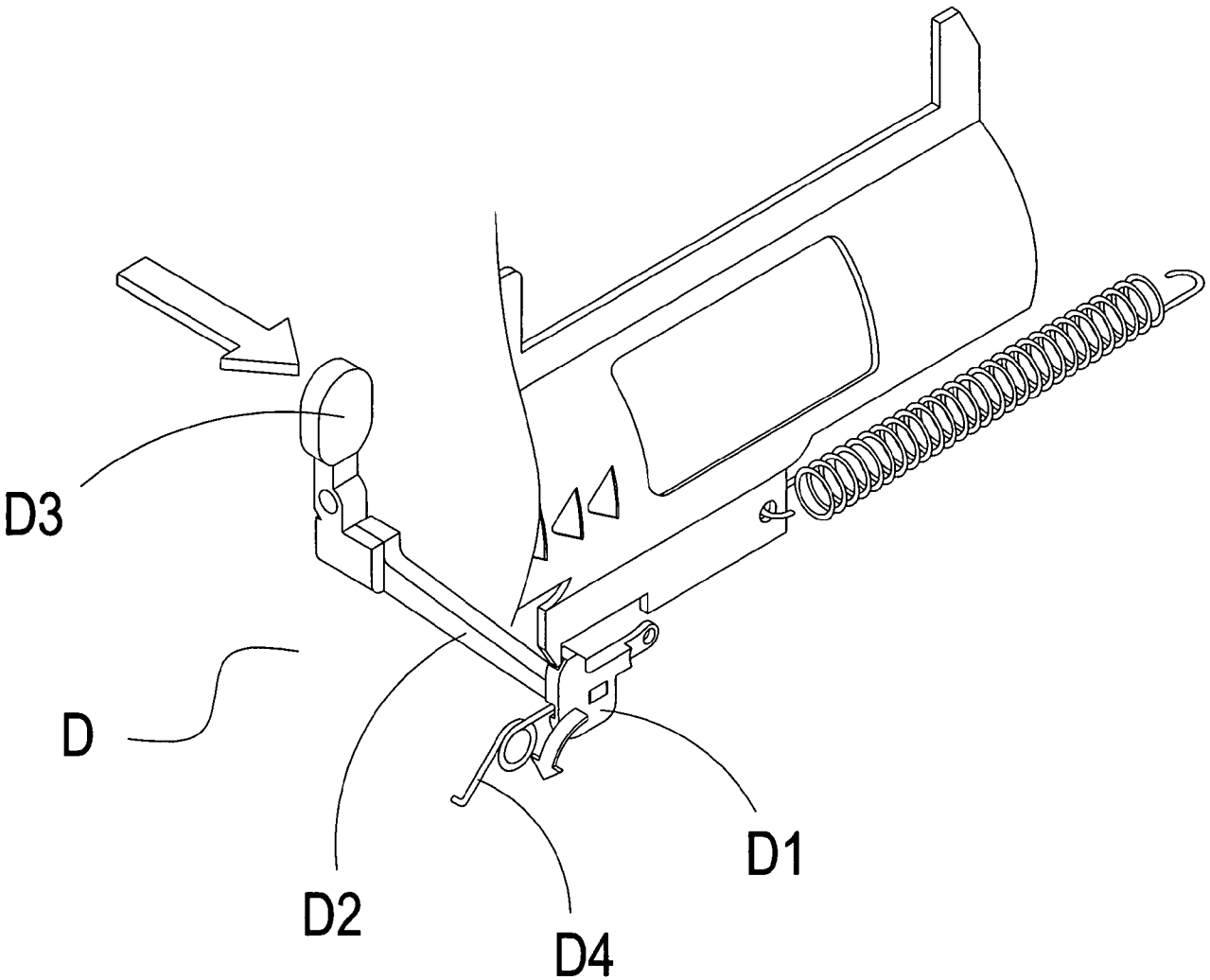
FIG. 4 shows a second schematic view of an embodiment of the present invention.
Figure 5:
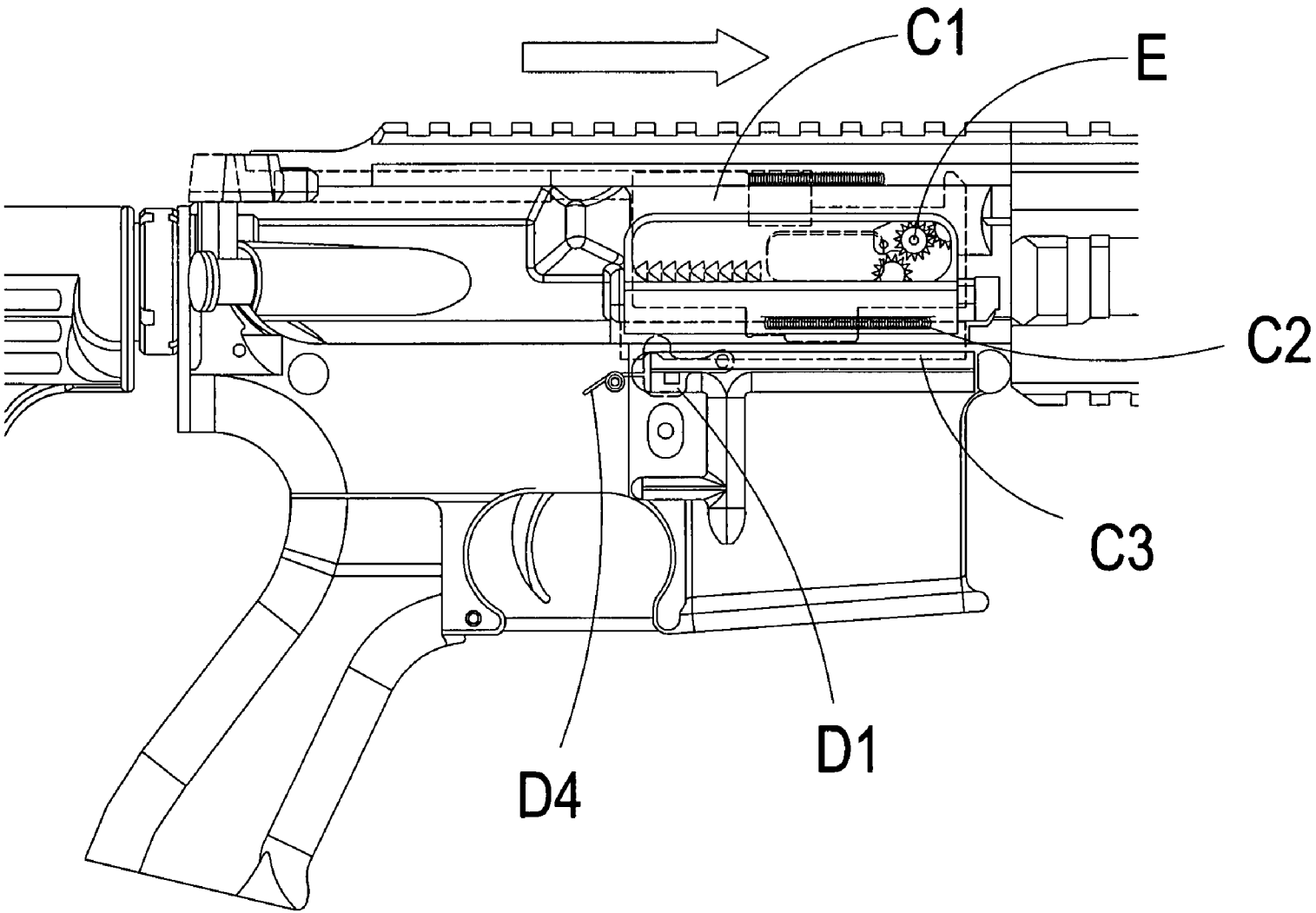
FIG. 5 shows a third schematic view of an embodiment of the present invention.
Figure 6:
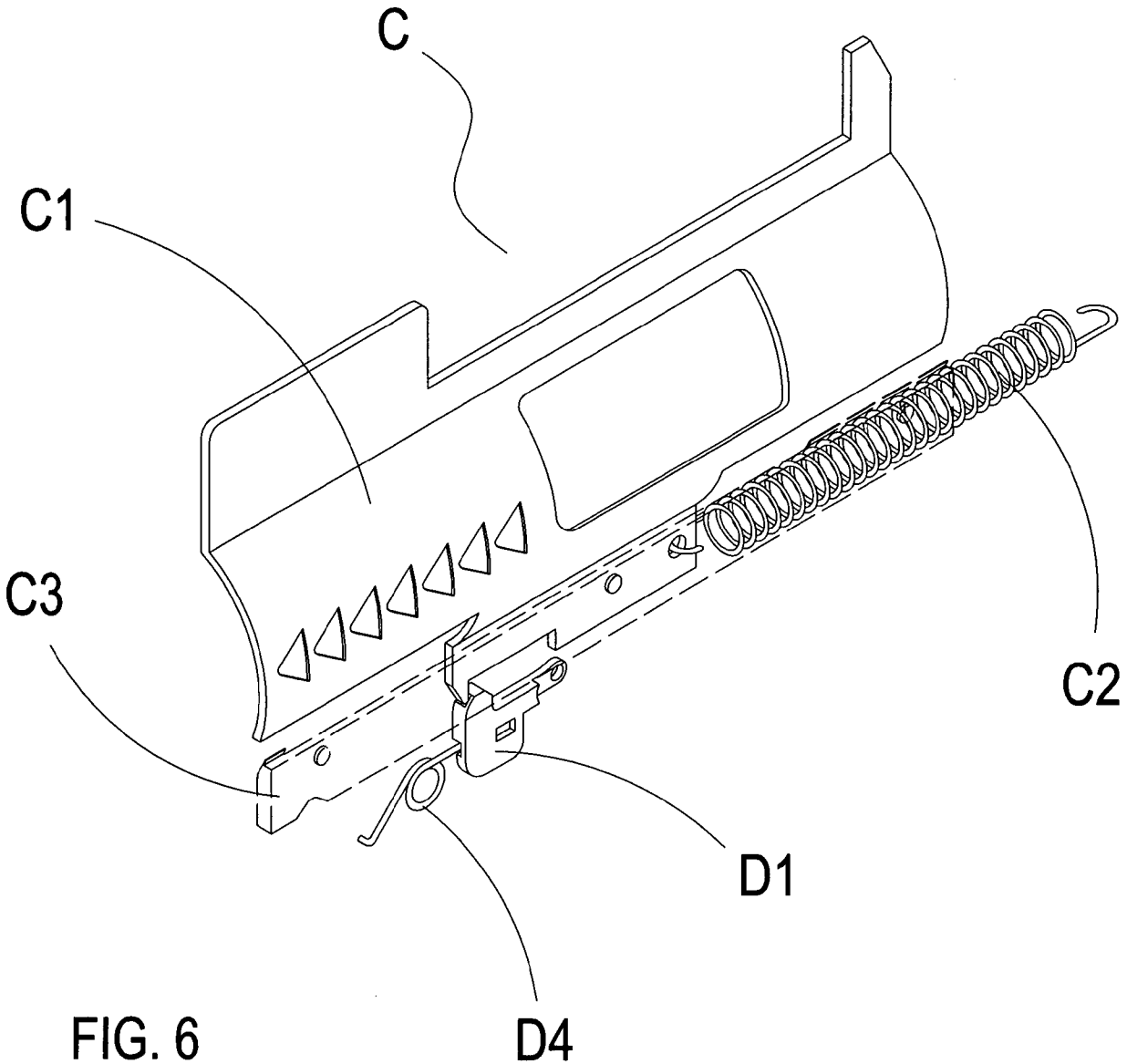
FIG. 6 shows a fourth schematic view of an embodiment of the present invention.

Referring to FIG. 1 and FIG. 2, the present invention is to provide an action structure A, which is constituted by a handle part B, an action part C, and a tenon part D, wherein the handle part B includes a handle B1, a handle extension seat B2, and a handle extension spring B3; the action part C includes an action piece C1, an action extension spring C2, and a dummy action stop-piece C3, with a trajectory adjusting device E being enclosed by the action piece C1; and the tenon part D includes an action piece inner tenon D1, a tenon extension rod D2, an action release tenon D3, and a tenon torsion spring D4.

The handle B1 is extended with the handle extension seat B2, and a side edge of the handle extension seat B2 is formed with a projected piece which is corresponding to a side edge of the action piece C1, so as to drive the action piece C1. On the other hand, a lower rim of the action piece C1 is provided with a projected corner which is corresponding to an arc corner at an upper rim of the action piece inner tenon D1, such that the action piece C1 can be fixed at a rear side by this latching effect, and the trajectory adjusting device E which is enclosed by the action piece C1 can be exposed for an adjustment of the trajectory.

An end at the other side of the action piece inner tenon D1 is provided with the action release tenon D3 which is locked with the tenon extension rod D2, and the tenon extension rod D2 is provided with a projected body to be assembled with the action piece inner tenon D1, such that a matching piece can be formed by the action piece inner tenon D1 and the action release tenon D3, and the action piece C1 can be restored to its original position by pressing the action release tenon D3, thereby enabling the action piece C1 to be fixed at the rear side and to be restored to the original position.

Referring to FIGS. 3 to 6, the present invention is to provide an action structure A, which is composed of a handle part B (as shown in FIG. 2), an action part C, a tenon part D, and a trajectory adjusting device E. The handle part B (as shown in FIG. 2) includes a handle B1, a handle extension seat B2, and a handle extension spring B3. The action part C includes an action piece C1, an action extension spring C2, and a dummy action stop-piece C3 which is provided with a bump to be assembled with a cavity at a lower rim of the action piece C1, and which is connected to a frame along with the extended action extension spring C2. The action piece C1 encloses the trajectory adjusting device E, and the tenon part D includes an action piece inner tenon D1, a tenon extension rod D2, an action release tenon D3, and a tenon torsion spring D4.

A side end of the handle B1 is provided with a hook which is hooked to the extended handle extension spring B3 and is extended to the frame, and a side edge of the handle extension seat B2 is provided with a projected piece which is corresponding to a side edge of the action piece C1, such that the action piece C1 can be driven from an operation of the handle B1 by this latching effect. On the other hand, a lower rim of the action piece C1 is provided with a projected corner which is corresponding to a notch at an upper rim of the action piece inner tenon D1, such that when the handle B1 and the handle extension seat B2 operate to drive the action piece C1, the projected corner at the lower rim of the action piece C1 will cross over a top of the notch at the upper rim of the action piece inner tenon D1 to be mutually latched with the action piece inner tenon D1, such that the action piece C1 can be fixed at a rear side by the action piece inner tenon D1 through this latching effect. In addition, as the action piece C1 encloses the trajectory adjusting device E, the trajectory adjusting device E can be exposed for a following adjustment by fixing the action piece C1 at the rear side.

The action piece inner tenon D1 is extended with the tenon torsion spring D4, is extended to the frame, and is provided with a cavity. The other corresponding side of the action piece inner tenon D1 is provided with the action release tenon D3 which is extended with the tenon extension rod D2 to be assembled with the action release tenon D3, and the tenon extension rod D2 is provided with a projected body to be latched with the cavity of the action piece inner tenon D3, such that a matching piece is formed by the action piece inner tenon D1 and the action release tenon D3, and when the action release tenon D3 is pressed, the action piece inner tenon D1 of the matching piece is moved due to that the action release tenon D3 is pressed, and is at a same time moved downward from torsion force of the extended tenon torsion spring D4. Accordingly, as there is no notch at the upper rim of the action piece inner tenon D1 for the corresponding latching with the projected corner at the lower rim of the action piece C1, the action piece C1 can be restored to an original position by an operation of restoring force of the dummy action stop-piece C3 and the extended action extension spring C2. In the mean time, the action piece inner tenon D1 is also restored to its original position by restoring force of the extended tenon torsion spring D4, which enables the action piece C1 to be subjected to the same operation again.

To further manifest the advancement and practicability of the present invention, the present invention is compared with a conventional action structure as follow.

Shortcomings of a conventional action structure

1. The action piece and the action release tenon are only provided with the effect of beauty.
2. According to item 1, the action cannot be fixed at the rear side nor can be released.
3. The trajectory cannot be adjusted easily.

Advantages of the present invention

1. By operating the handle, the action can be fixed at the rear side.
2. By pressing the action release tenon, the action can be restored to its original position.
3. The trajectory can be adjusted by a single hand.
4. It is provided with the advancement and practicability.
5. It can improve industrial competitiveness.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. An action structure comprising a handle part, an action part, a tenon part, and a trajectory adjusting device, wherein when a handle operates, by an handle extension seat, which is extended to the action, the action will be driven; and by a fact that a lower rim of the action is engaged by an upper rim of an action piece inner tenon of the tenon part to latch a rear side of the action; through fixing the action at the rear side, and exposing the trajectory adjusting device which is enclosed by the action at a same time, the trajectory being adjusted; a corresponding side of the action piece inner tenon being provided with an action release tenon which is assembled with the extended action piece inner tenon through an extended tenon extension rod, such that a matching piece is formed by the action release tenon and the action piece inner tenon, and the action is restored to an original position by pressing the action release tenon, thereby achieving an effect of simulating a real gun through a recoil movement of the action.

2. The action structure according to claim 1, wherein the function that the action is fixed at the rear side is further applied to a pistol, a rifle, a gas gun, and other related toy gun which is provided with the handle.

3. The action structure according to claim 1, wherein the function that the action is restored to the original position is further applied to a pistol, a rifle, a gas gun, and other related toy gun which is provided with the action release tenon and the action piece inner tenon.

* * * * *